US006347949B1

(12) United States Patent
Edwards et al.

(10) Patent No.: US 6,347,949 B1
(45) Date of Patent: Feb. 19, 2002

(54) AC/DC POWER ACCOMMODATION METHOD AND APPARATUS FOR NETWORKING/TELECOMMUNICATIONS DEVICES

(75) Inventors: William F. Edwards, Livermore; Earl Devenport, San Jose, both of CA (US); Robert Gregory Twiss, Chapel Hill, NC (US)

(73) Assignee: Cisco Technology Inc., San Jose, CA (US)

( * ) Notice: Subject to any disclaimer, the term of this patent is extended or adjusted under 35 U.S.C. 154(b) by 0 days.

(21) Appl. No.: 09/608,491

(22) Filed: Jun. 30, 2000

(51) Int. Cl.[7] ..... H01R 29/00
(52) U.S. Cl. ..... 439/170
(58) Field of Search ..... 439/170, 638, 439/61, 356, 365, 653, 59; 361/683, 686, 799

(56) References Cited

U.S. PATENT DOCUMENTS 4,736,177 A * 4/1988 Vollmer et al. ..... 439/364
4,756,695 A * 7/1988 Lane et al. ..... 439/76
5,136,468 A * 8/1992 Wong et al. ..... 439/61
5,397,929 A * 3/1995 Hogarth et al. ..... 439/653
5,641,953 A 6/1997 Fisher, Jr. ..... 200/50.12
5,712,779 A 1/1998 Sheppard et al. ..... 363/69
5,770,898 A 6/1998 Hannigan et al. ..... 307/147

* cited by examiner

*Primary Examiner*—Brian Sircus
*Assistant Examiner*—Phuong KT Dinh
(74) *Attorney, Agent, or Firm*—Skjerven Morrill MacPherson LLP

(57) ABSTRACT

An adaptor is provided for effectively converting an opening in the chassis or box of a router (or similar device) from an opening which accommodate a power entry component for a first power type to accommodate a power entry component for a second power type. In one aspect, an adaptor fits in a panel opening which is sized and shaped to receive an IEC-compliant AC power entry component. The adaptor has a window or opening which accommodates, e.g. a four-wire DC power entry component. In one aspect, an adaptor couples to screw holes, such as on either side of an RPS coupler and also receives a standard ground wire log, preferably forming a conductive path from the lug to the screw holes.

20 Claims, 4 Drawing Sheets

AC/DC POWER ACCOMMODATION METHOD AND APPARATUS FOR NETWORKING/TELECOMMUNICATIONS DEVICES

The present invention relates to a method and apparatus for accommodating first and second power types and in particular a method and apparatus to configure networking/telecommunications devices to accommodate either of a first and second power type such as AC power and DC power.

BACKGROUND INFORMATION

A number of devices which have uses in networking and/or telecommunications applications, such as switches, routers, hubs, bridges, gateways, and the like, are configured for receiving electrical power from an external source or line. A number of different power types are used including various voltages of alternating current (AC) and/or direct current (DC). For example, many common telecommunications devices are configured for AC power such as 110 volt, 60 hertz AC power in North America, 220 V. in Europe and the like. Many telecommunications devices are configured for DC power such as 48 volt DC power in North America.

Typically, devices which accommodate different power sources are configured differently, such as by providing different power supply devices or circuitry and/or providing different power entry configurations or components. Power supplies are often provided as substantially modular components which can be physically and electrically coupled to other electronic components in a networking or telecommunications device. Power entry configurations or components in general refers to plugs or similar couplings, and corresponding chassis openings, for connecting power lines, ground lines and the like, for purposes of transmitting power or ground through the chassis or body of a device, to the power supply or other internal components of the device.

Many power entry components are configured as, or include, plugs, jacks or couplings which are mounted on and/or extend at least partially through a wall of a box or chassis. A number of standards have been developed defining configurations for power entry components which are typically unique to various power types, e.g., to avoid coupling the wrong power type to a networking or telecommunications device. For example, a four-lead DC power entry component has a shape which is substantially different from a 110 volt single-phase grounded AC power entry component, e.g., as defined by the International Engineering Consortium (IEC) (IEC-compliant). Because the plug configurations are typically made purposely differently, for different power types, such plugs are often configured for coupling to a chassis or box opening having a size and/or shape which is substantially unique to that power type. As a result, in a typical situation, when a networking or telecommunications device is designed, the box or chassis for such device will be designed to either accommodate a plug or other power entry component for a first power type or accommodate a plug or other power entry component for a second power type. For example, a chassis intended for an IEC AC power entry component will be provided with a 28 mm by 20 mm opening in the chassis or box while a chassis or box intended for DC power supply will be provided with a 20 mm by 15 mm opening (as well as, perhaps, other components, e.g., for accommodating a ground lug and the like).

Approaches which provide different chassis or boxes, depending on the intended power type (even when other functions of the electronic component may be similar to one another or substantially the same) presents a number of problems. The differences can constrain manufacturing logistics, e.g. since the different products may be produced on separate manufacturing lines, and the like. There are a number of expenses associated with providing a box or chassis for accommodating a power type, including design time and other expenses associated with determining the size, shape and location of openings, screw holes or other mounting components and the like, especially when openings must be positioned to accommodate proper configuration of cables and the like with respect to a power supply or other interior components and must fulfill other design constraints such as avoiding uncovered openings (which can create undesirable levels of electromagnetic interference, safety concerns and the like), the cost of designing and creating tooling to provide the desired openings in the (typically sheet metal) chassis or box, the cost of designing, producing or installing screw holes, clips or other couplings configured to hold the power entry components, and/or the cost of maintaining an inventory of two or more different types of chassis or boxes. The per-unit cost can be especially burdensome when a manufacturer produces relatively few of one of the configurations. Accordingly, it would be useful to provide a system, method and apparatus for providing a single chassis, box or panel configuration which can be used in providing equipment configured for either of a first or second power type (such as AC power or DC power). Although embodiments of the present invention have been described in connection with power for networking or telecommunications devices, there is no theoretical reason why the invention cannot be used in connection with other types of devices such as personal computers or laptop computers, hand-held computers, portable electronic items such as telephones, pagers, office equipment, entertainment devices and the like.

Previous approaches which used different box or chassis configurations for different power types made it difficult or infeasible to convert an apparatus which was originally intended for a first power type, into an apparatus which could use a second power type. Accordingly, it would be useful to provide a method, system or apparatus which can readily achieve a power-type conversion or retrofit capability between two or more different power types.

SUMMARY OF THE INVENTION

The present invention includes a recognition of the existence, source and/or nature of problems in previous approaches, including as described herein. In one aspect, an adaptor is provided which can couple to a power entry component intended for a first power type and which can also couple to an opening or coupling of a chassis, box or panel which is intended for a second, differently sized or shaped power entry component (or adaptor) for a second power type. In one illustrative example, a networking or telecommunications device has a chassis which includes an opening sized and shaped to accommodate a standard, commercially available AC power entry plug or coupling, e.g., complying with IEC standards. An adaptor is provided which has an exterior perimeter and/or couplings configured to fit in, or couple to, the opening but which also has an interior opening or window configured to accommodate and/or couple a DC power entry component, preferably a standard, commercially available DC power entry component. By coupling the DC power entry component to the adaptor and coupling the adaptor to the AC opening, a DC power entry component can be accommodated in a chassis or box which was configured for accommodating an AC power entry component, substantially without modification, redesign, retooling and the like in fabricating the chassis or box.

In one embodiment, the chassis or box of a networking or telecommunications device includes an opening for accommodating a remote power supply pin (RPS) coupling or connector which includes a first set of connector-mounting screw holes, spaced-apart a first distance. An adaptor is provided which can be mounted to the first set of screw holes so as to both cover the RPS opening (which is not needed in, or used in, a DC configuration) and to provide a second set of screw holes, in the adaptor, spaced apart a second distance, which is defined to accommodate a standard, commercially available, ground wire lug. In this way, not only is an opening desirably covered, but a opportunity for mounting a standard ground lug is provided without having to provide additional screw holes. Preferably, the adaptor is formed of a substantially conductive material or otherwise provides a conductive pathway from the ground lug to the chassis or box.

DETAILED DESCRIPTION OF THE PREFERRED EMBODIMENT

Figure 1A:
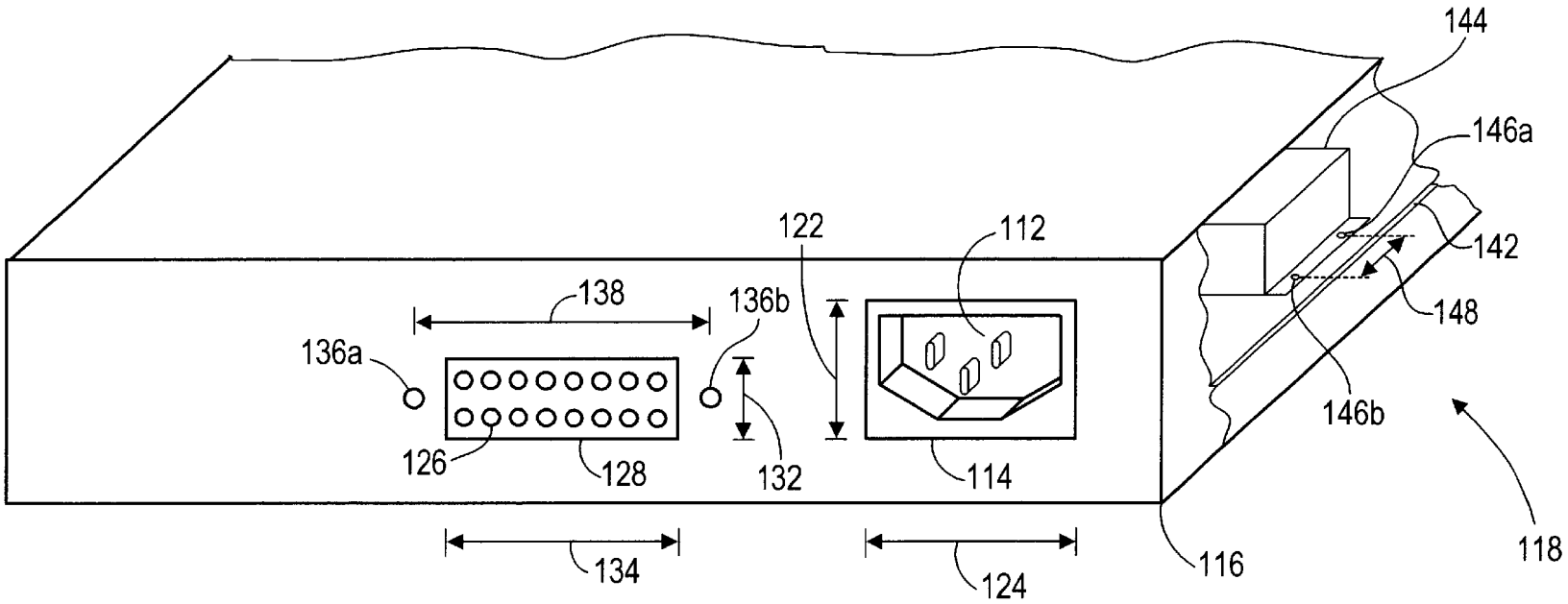
Fig. 1A (Prior Art)
FIGS. 1A and 1B are simplified rear perspective, partially cutaway views showing the external appearance of a box or chassis configured for AC power and DC power respectively.

FIG. 1A illustrates a typical AC-configured box (e.g., of a router, hub, gateway or other component of a network) according to previous approaches. In the configuration of FIG. 1A, an AC entry component 112 is accommodated in a cutout or opening 114 in a rear panel 116 of the box 118 with the cutout having a first height 122 of about 20 mm and a width 124 of about 28 mm. In the depicted embodiment, the rear panel 116 also includes an RPS coupling 126 positioned in a cutout 128 having a height 132 and width 134. Threaded holes 136*ab,* e.g., for securing a connector or fastener, form a hole pattern in the depicted embodiment, being a pair of holes 136*a,b* spaced a distance apart 138.

As will be understood by those of skill in the art, the interior of the box 118 commonly contains a number of electronic components including, e.g., a main circuit board or motherboard 142 with power supply 144 (which receives AC power via the power entry 112 and wires or cables (not shown) and outputs power for use by the circuitry at one or more predefined voltages) coupled by screws or bolts or rivets 146*a,b* with a predefined spacing 148.

Figure 1B:
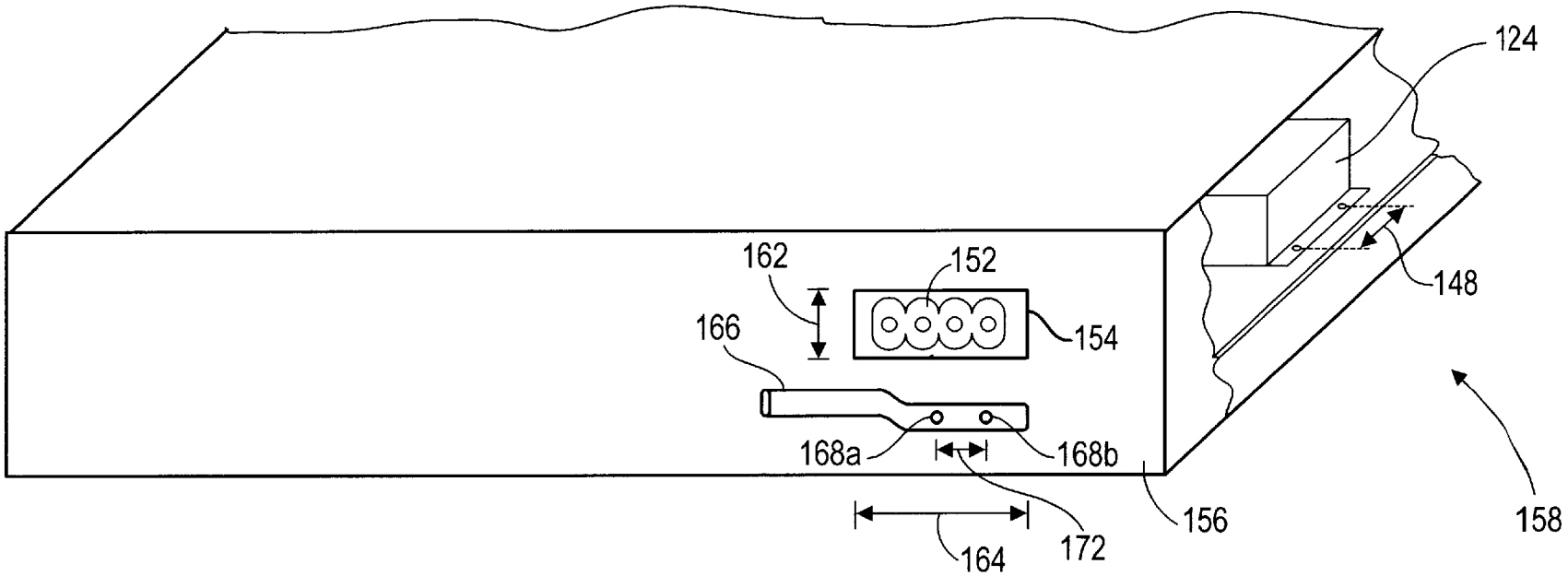
Fig. 1B (Prior Art)

FIG. 1B depicts a chassis or box 158 of a type that may be used for a DC implementation. In the configuration of FIG. 1B, a DC power entry plug 152 is positioned in a cutout 154 in a rear panel 156 having a height 162 and a width 164. The cutout height 162 and width 164 for accommodating the DC plug 152 is, in general, substantially different from the cutout height 122 and width 124 for accommodating the AC plug 112 (FIG. 1A). For example, in the AC configuration, the height 122 may be about 20 mm, the width 124 may be about 28 mm, whereas in the DC configuration, height 162 may be about 15 mm and the width 164 may be about 20 mm. Accordingly, in general, if it is desired to provide both AC configurations (FIG. 1A) and DC configurations (FIG. 1B) it is necessary to design, fabricate and stock two different chassis or boxes, a first 118 with openings 114 configured for AC power entry and a second 158 with openings 154 configured for DC power entry.

In the configuration of FIG. 1B, a ground wire lug 166 is coupled with bolts, screws or rivets defining a ground lug hole pattern in the depicted embodiment being a pair of holes 168*a,b* spaced a distance apart 172 which, in general, will be different from the spacing 138 of the threaded holes 136*ab* associated with the RPS of the AC configuration (FIG. 1A). Preferably, the lug adaptor is formed of a substantially conductive material, or coated, with a substantially conductive material and the screw holes 236*a,b* are used for coupling to a ground wire to provide a conductive path from the ground lug to a ground wire. In one embodiment, the lug adaptor is formed from tin-plated steel. The DC power supply 174 can be provided in a size, shape and hold spacing 148 to be accommodated in substantially the same space, and in the same manner, as the AC supply 144 in the AC configuration (FIG. 1A).

Figure 2:
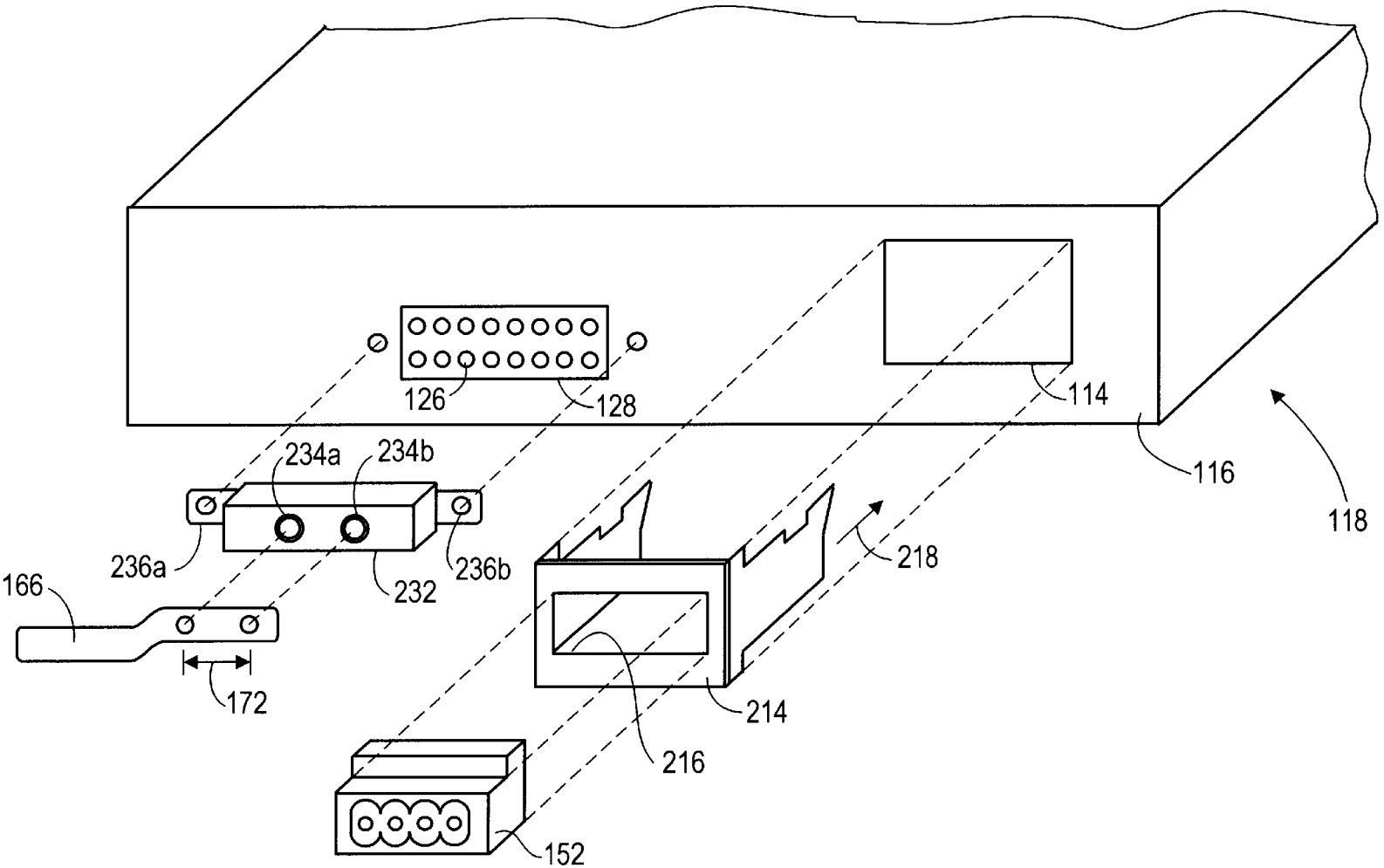
FIG. 2 is a partial rear perspective view, partially exploded, depicting adaptors for accommodating DC power entry components in a chassis or box configured for AC power, according to an embodiment of the present invention.
Figure 4:
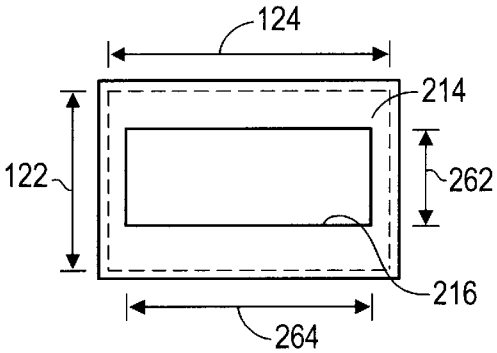
FIG. 4 is an elevational view of a power entry plug converter according to an embodiment of the present invention.
Figure 3:
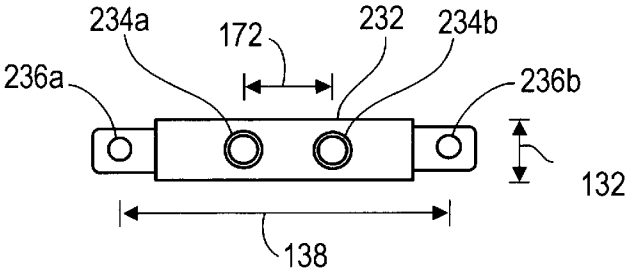
FIG. 3 is an elevational view of a ground lug adaptor according to an embodiment of the present invention.

FIG. 2 illustrates one manner in which, according to an embodiment of the present invention, the same chassis 118 can be used for both an AC configuration and a DC configuration, without the need to substantially modify or redesign the chassis. As shown in FIG. 2, the chassis 118 includes, in its rear panel 116, a cutout 114 of a size and shape configured to accommodate a AC power entry (as illustrated in FIG. 1A). However, in the embodiment of FIG. 2, rather than the cutout 114 receiving an AC power entry plug 112, it instead, receives an adaptor 214 which defines an opening 216 sized and shaped to receive the DC power entry unit 152'. As best seen in FIG. 4, the adaptor 214 has exterior dimensions defining a height 122 and width 124 to fit in or be accommodated by the (AC-shaped) opening 114. However, an interior opening or window 216 has a height 162 and width 164 which accommodates at least the coupling area of the DC plug 152. In one embodiment, the window height 262 is substantially equal to the height 162 of the opening in the DC configuration and the window width 264 is substantially equal to the width 164 of the power entry opening 154 of the DC configuration of prior approaches (FIG. 1B).

Figure 5:
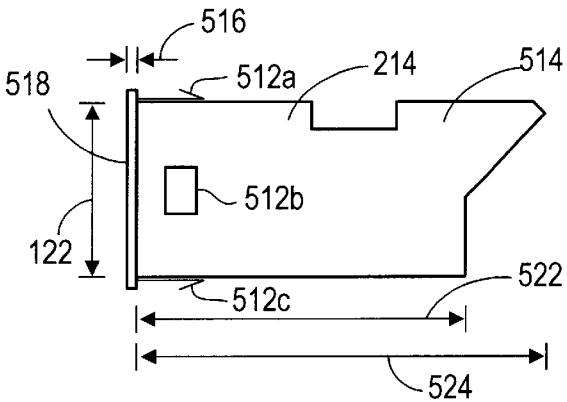
FIG. 5 is a side view of the converter of FIG. 4.

Preferably, the adaptor 214 can be positioned or coupled within the opening 114 without the need for separate fasteners and/or tools. In the embodiment best seen in FIG. 5, the adaptor 214 is provided with a plurality of resilient tabs 512*abc*. The rearward portion 514 of the adaptor 214 is inserted 218 through the opening 114 with the resilient tabs 512*abc* being deflected inwardly to permit their passage through the opening 114. Once passing through the opening 114 the resilient tabs 512*abc* return to their undeflected positions as depicted in FIG. 5 so as to capture the thickness of the rear panel 116 within the space 516 defined between the tabs 512*a,* 512*b,* 512*c* and the front portion or plate 518 of the adaptor 214. Although a number of configurations are possible, in the depicted embodiment the lower surface of the adaptor 214 has a length 522 of about 24 mm and the upper surface has a length 524 of about 27 mm. Those of skill in the art will understand how to devise other shapes and configurations for an adaptor 214 such that the adaptor will be accommodated in or be coupled to the opening 114 and can receive at least the coupling portion of a DC entry module 152'.

As seen in FIG. 1A, the AC configuration does not include specific openings for coupling a ground lug. In the embodiment of FIG. 2, a lug adaptor 232 is provided which defines or includes threaded holes 234*ab* (or other openings or cutouts) with a spacing equal to the spacing 172 of a ground lug 166 so that the ground lug 166 can be readily coupled to the adaptor 232, e.g., using screws, bolts, and the like (not shown). The lug adaptor 232 also includes coupling devices such as bolt or screw holes 236*ab* for coupling to the box or chassis 118. Since it is preferred to avoid having to make modifications or changes to the AC chassis or box 118, preferably the lug adaptor 232 can be coupled to the chassis 118 without creating or providing additional screw holes or the like. In the depicted embodiment, the lug couplings 236*ab* are sized and spaced to match the RPS threaded holes 136*ab* so that the lug adaptor 232 can be fastened to the chassis 118 in a position substantially covering the RPS opening 128. This configuration not only provides the advantage of avoiding the need for new holes or similar devices in order to attach the lug adaptor 232 (and made possible by the fact that an RPS is typically not used in a DC environment) but also can be used to cover the RPS opening 128 (whether or not an RPS connector 126 is provided within the opening 128, which can be useful in avoiding unwanted electromagnetic interference, safety concerns and the like).

In operation, when it is desired to provide a AC component, an AC-type box or chassis 118 can be provided and outfitted as depicted in FIG. 1A. However, when it is desired to provide a corresponding DC component, the same box or chassis 118 can be provided and assembly personnel can be furnished with a package of DC components including adaptor 214, adaptor lug 232, as well as the DC components normally provided such as DC power entry module 152', ground lug 166 and DC power supply 174. By installing the adaptors and other components as depicted in FIG. 2 and coupling the DC power supply 174, a DC component is provided using a substantially unmodified AC chassis or box 118.

In light of the above description, a number of advantages of the present invention can be seen. The present invention can be used to provide relatively easy product conversion from AC to DC power. Preferably the change can be implemented substantially as a manufacturing change (as opposed to, e.g., an engineering change). For example, the change can be accomplished with a bill of materials (BOM) change, i.e., substantially without the need for making sheet metal or other changes to a chassis or box, thus achieving a relatively inexpensive manner of providing a DC power supply conversion. Preferably, some or all adaptors or other parts are installed by a snap-in installation, without the need for separate screws or similar fasteners and without the need for tools, or, in some cases, using only simple hand tools such as screwdrivers, nut drivers and the like. The present invention can be applied to a wide variety of electronic devices to provide multiple different power type versions using the same chassis or box. Some or all features of the present invention can be used to retrofit into existing chassis designs or boxes and/or existing assembled electronic components to provide for a different power supply type. The present invention can substantially avoid uncovered openings so as to assist in reducing electromagnetic interference, safety concerns and the like.

A number of variations and modifications of the invention can be used. It is possible to use some features of the invention without using others. For example, it is possible to use the power entry adaptor without using the lug adaptor and the like. Although power entry is traditionally provided in a rear panel, there is no theoretical reason why the present invention cannot be used in electronic components with power entry in other regions or surfaces. In some embodiments, it may be desired to provide an opening which is larger than the opening for any of a plurality of desired power types and to provide for adaptors for each desired power type. Although it is preferred to form the power entry adaptor from injection-molded plastic, it is also possible to form the adaptor form other materials such as resins, fiberglass, ceramic and the like. Although, in one embodiment, the ground lug adaptor is formed from tin-plated steel, other materials achieving the desired conductive pathway can be used including aluminum or plated copper. Although a specific example, with specific associated sizes, relating to IEC-AC power entry and DC power entry components has been described, the present invention can be used in connection with any of a variety of power types including 220 volt power supplies of the type common in Europe, three-phase power, various voltages of DC power and/or numerous different shapes and sizes of power entry modules or plugs. Although an embodiment was described in which an opening can accommodate either an unmodified entry component for a first power type or an entry component for a second power type, other configurations are also possible. For example, it is possible to use a configuration in which a collar or adaptor for both an entry component for a first power type and an entry component for a second power type is used, with a chassis, box or panel opening configured to accommodate either of the two adaptors. It is possible to provide a chassis, box or panel opening which accommodates two or more entry component adaptors. It is possible to configure an adaptor to perform a function in addition to its adaptor function, such as holding or guiding cables or other components and the like. Although it is believed economically preferable to use an adaptor for fitting a standard sized, commercially available entry component to an opening, it would be possible (even if not economically advantageous) to provide a single part which performs the functions of both standard entry component and adaptor (e.g., by reconfiguring the peripheral shape and/or size of a standard power entry component). Although an embodiment was depicted in which the adaptor defines a substantially rectangular opening and in which the chassis or box opening is substantially rectangular. The present invention can be used in connection with other sizes or shapes of openings. Although the adaptor opening as depicted has opening edges which are spaced from exterior adaptor edges, it is also possible to provide an opening with one or more edges contiguous with adaptor edges and/or panel opening edges. Although in the depicted embodiment, the ground lug hole pattern and chassis hole pattern are pairs of spaced apart holes, the present invention can also be implemented in embodiments in which either or both of the ground lug hole and/or chassis hole patterns are different patterns such as forming a triangular pattern, quadrilateral pattern, circular pattern, array or grid, and the like. Although the depicted embodiments illustrate connector receiving areas 234*ab* which are in the form of threaded holes, other connector receiving areas can be used such as through holes, un-shaped cutouts, latches and the like.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An apparatus for accommodating first and second power types in a networking/telecommunications device, said networking/telecommunications device having at least a first panel region defining at least a first opening in said panel region, said first opening having a first opening perimeter with a first size and shape which is able to accommodate a first power entry component with a first power entry perimeter size and shape, said first power entry component being an AC power entry component, said apparatus comprising:

a DC power entry component having a perimeter with a size and shape different from said first power entry perimeter size and shape; and an adaptor having an adaptor perimeter with a second size and shape such that said adaptor perimeter can be accommodated within said first opening, said adaptor defining an adaptor opening having a third size and shape which can accommodate said DC power entry component, said adaptor at least partially positioned within said first opening in an adaptor position, said adaptor being coupled in said adaptor position, with respect to said panel.

2. An apparatus, as claimed in claim 1, wherein said first panel region is a rear panel of a chassis or box.

3. An apparatus, as claimed in claim 1, wherein said first power entry component is an IEC-compliant AC power entry component.

4. An apparatus, as claimed in claim 1, wherein said second power entry component is a four-wire DC power entry component.

5. An apparatus, as claimed in claim 1, wherein said adaptor is formed by injection molding a thermoplastic resin.

6. An apparatus, as claimed in claim 1, wherein said networking/telecommunications device is selected from the group consisting of network switches, routers, hubs, bridges and gateways.

7. An apparatus for mounting a ground lug, having a first coupler pattern, to a chassis having a chassis hole pattern different from said first coupler pattern, comprising:

an adaptor member having a first adaptor hole pattern at least partially matching said chassis hole pattern and coupleable to said chassis using said first adaptor hole pattern;

said adaptor member having connector receiving regions defining a pattern at least partially matching said first coupler pattern, said ground lug coupleable to said adaptor member by connectors received in at least some of said connector receiving regions.

8. An apparatus, as claimed in claim 7, wherein said adaptor member includes substantially conductive material forming a substantially electrically conductive pathway from said ground lug to said chassis.

9. An apparatus, as claimed in claim 7, wherein said adaptor member is substantially formed from an electrically conductive material.

10. A method for accommodating first and second power types in a networking/telecommunications device, said method comprising: comprising:

providing a networking/telecommunications device having at least a first panel region defining at least a first opening in said first panel region, having a first opening perimeter with a first size and shape able to accommodate an AC power entry component perimeter size and shape; and coupling an adaptor, having an adaptor perimeter with a second size and shape such that said adaptor perimeter can be accommodated within said first opening, in an adaptor position with respect to said first panel region, said adaptor being at least partially positioned within said first opening, said adaptor defining an adaptor opening having a third size and shape which can accommodate a DC power entry component, said DC power entry component having a perimeter with a size and shape different from said AC power entry perimeter size and shape, in an adaptor position.

11. A method, as claimed in claim 10, wherein said AC power entry component is an IEC-compliant AC power entry component.

12. A method, as claimed in claim 10, wherein said DC power entry component is a four-wire DC power entry component.

13. A method for mounting a ground lug, having a first hole pattern, to a chassis having a second hole pattern different from said first hole pattern; comprising:

coupling an adaptor member, having a third hole pattern at least partially matching said second hole pattern, to said chassis, using said third hole pattern, said adaptor having connector receiving regions defining a fourth pattern at least partially matching said first hole pattern; and coupling said ground lug to said adaptor by connectors received in at least some of said connector receiving regions.

14. A method, as claimed in claim 13, further comprising forming a substantially electrically conductive pathway from said ground lug to said chassis.

15. A system for accommodating first and second power types in a networking/telecommunications device, said networking/telecommunications device having at least a first panel region defining at least a first opening on a chassis, said first opening having a first opening perimeter with a first size and shape capable of accommodating an AC power entry component with an AC power entry perimeter size and shape, said system comprising:

means defining a second opening having a second size and shape for accommodating a DC power entry component, said DC power entry component having a perimeter with a size and shape different from said AC power entry perimeter size and shape, said means having a means perimeter with a size and shape such that said means perimeter can be accommodated within said first opening, said means at least partially positioned within said first opening in a predetermined position, said means being coupled in said predetermined position, with respect to said first panel region;

an adaptor member having a first adaptor hole pattern at least partially matching a chassis hole pattern and coupleable to said chassis using said first adaptor hole pattern, said adaptor member having connector receiving regions; and a ground lug coupleable to said adaptor member by connectors received in at least some of said connector receiving regions.

16. A system as claimed in claim 15, wherein said AC power entry component is an IEC-compliant AC power entry component.

17. A system as claimed in claim 15, wherein said DC power entry component is a four-wire DC power entry component.

18. A system as claimed in claim 15, wherein said networking/telecommunications device is selected from the group consisting of network switches, routers, hubs, bridges and gateways.

19. An apparatus for mounting a ground lug having a first coupler pattern to a chassis having a second hole pattern different from said first coupler pattern, said apparatus comprising:

an adaptor member having first coupling means defining a first pattern at least partially matching said second hole pattern and coupleable to said chassis using said first coupling means;

second coupling means in said adaptor defining a second pattern at least partially matching said first coupler pattern, said ground lug coupled to said adaptor using said second coupling means.

20. An apparatus, as claimed in claim 19, further comprising means for forming a substantially electrically conductive pathway from said ground lug to said chassis.

* * * * *